US011548117B2

(12) United States Patent
Liu

(10) Patent No.: US 11,548,117 B2
(45) Date of Patent: Jan. 10, 2023

(54) POSITIONING STRUCTURE OF CLAMP

(71) Applicant: Sung-Chi Liu, Taichung (TW)

(72) Inventor: Sung-Chi Liu, Taichung (TW)

( * ) Notice: Subject to any disclaimer, the term of this patent is extended or adjusted under 35 U.S.C. 154(b) by 0 days.

(21) Appl. No.: 17/344,922

(22) Filed: Jun. 10, 2021

(65) Prior Publication Data

US 2021/0387311 A1 Dec. 16, 2021

(30) Foreign Application Priority Data

Jun. 11, 2020 (TW) ..... 10911968.7

(51) Int. Cl.
*B25B 5/06* (2006.01)
*B25B 5/16* (2006.01)
*B25B 5/02* (2006.01)

(52) U.S. Cl.
CPC ..... *B25B 5/068* (2013.01); *B25B 5/02* (2013.01); *B25B 5/163* (2013.01); *B25B 5/166* (2013.01)

(58) Field of Classification Search
CPC .... B25B 3/00; B25B 5/00; B25B 5/02; B25B 5/068; B25B 5/163; B25B 5/166
USPC ..... 269/3, 6, 46, 16
See application file for complete search history.

(56) References Cited

U.S. PATENT DOCUMENTS 8,366,089 B2 * 2/2013 Chen ..... B25B 5/068 269/95
8,827,251 B2 * 9/2014 Kuo ..... B25B 5/068 269/95
2009/0146358 A1 * 6/2009 Yang ..... B25B 5/068 269/254 R
2012/0098182 A1 * 4/2012 Yang ..... B25B 5/166 269/208

FOREIGN PATENT DOCUMENTS

TW M336850 B1 7/2008

* cited by examiner

*Primary Examiner* — Joseph J Hail
*Assistant Examiner* — Alberto Saenz
(74) *Attorney, Agent, or Firm* — Che-Yang Chen; Law Office of Michael Chen

(57) ABSTRACT

A positioning structure of clamp may include a fixed clamp and a guiding rod, and the fixed clamp has a clamping portion and a connecting portion respectively at an upper portion and a lower portion thereof, and a guiding hole penetrates through the connecting portion. The guiding rod coupled into the guiding hole comprises a plurality of first through holes thereon, a first engaging hole and a second engaging hole respectively penetrating through two lateral sides of the connecting portion are respectively communicated with the guiding hole. A plurality of lock holes are formed at the lateral side of the connecting portion same as the second engaging hole. A positioning unit, connected to the connecting portion through the first engaging hole, the second engaging hole, and the lock holes, comprises a clamping block, an engaging block, a positioning bolt, a positioning block, a clamping plate and a rotating member.

5 Claims, 15 Drawing Sheets

POSITIONING STRUCTURE OF CLAMP

FIELD OF THE INVENTION

The present invention relates to a clamp structure and more particularly to a positioning structure of clamp.

BACKGROUND OF THE INVENTION

As disclosed in Taiwan Patent Publication No. M336850, the conventional clamp structure comprises a fixed clamp (100) and an adjustable clamp (200). The fixed clamp (100) is disposed and secured on a guiding rod (300), and the adjustable clamp (200) is disposed on the guiding rod (300) with a distance (D) from the fixed clamp (100) so as to clamp an object. The adjustable clamp (200) is movable to adjust the distance (D) to clamp the object with different sizes. The adjustable clamp (200) has a main body (10), a jaw block (11), a guiding hole (12), a threaded portion (13), an axle track (14). The axle track (14) is located at the center of the threaded portion (13) and is communicated with the guiding hole (12), and the axle track (14) comprises a axle hole portion (141) and two expanded hole portions (142)(143). Also, the clamp structure has an adjustable unit (20) comprising a button (21), an engaging member (22), and a bolt (23). The button (21) is secured on the threaded portion (13) of the main body (10), and the engaging member (22) having a through hole (221) is disposed in the axle track (14) and abutted against one end of the guiding rod (300), and the bolt (23) is adapted to penetrate through the through hole (221) of the engaging member (22).

However, the conventional clamp structure has following disadvantages: (i) since the engaging member (22) is directly disposed in the axle track (14), the diagonal force from the jaw block (11) applies on the engaging member (22) when the objected is clamped, and also the engaging member (22) is directly forced by the axle track (14), such that after the clamp used for a period of time, a gap is formed between the engaging member (22) and the axle track (14) so as to cause the main body loosened. Therefore, there remains a need for a new and improved design for a positioning structure of clamp to overcome the problems presented above.

SUMMARY OF THE INVENTION

The present invention provides a positioning structure of clamp comprising a fixed clamp and a guiding rod, and the fixed clamp has a clamping portion and a connecting portion respectively at an upper portion and a lower portion thereof, and a guiding hole penetrates through the connecting portion. The guiding rod coupled into the guiding hole of the connecting portion comprises a plurality of first through holes thereon, and a first engaging hole and a second engaging hole respectively penetrating through two lateral sides of the connecting portion are respectively communicated with the guiding hole. A plurality of lock holes are formed at the lateral side of the connecting portion same as the second engaging hole. A positioning unit, which is connected to the connecting portion through the first engaging hole, the second engaging hole, and the lock holes, comprises a clamping block, an engaging block, a positioning bolt, a positioning block, a clamping plate, and a rotating member. The clamping block has an engaging ring protruding from an end thereof, and the outer periphery of the engaging ring is formed into peripheral teeth, and a first connecting hole axially penetrates through the center of the clamping block. The engaging block comprises a positioning ring protruding from an end thereof, and a second connecting hole axially penetrates through the center of the engaging block. An engaging surface is formed at an end of the second connecting hole, and each of two sides of the engaging surface has a guiding portion. The positioning bolt has a textured finish section at the outer periphery of one section of the positioning bolt while the other section thereof comprises a positioning plane. The positioning block comprises a second through hole axially penetrating through the center thereof, and at least two guiding columns protrude from the outer periphery of the positioning block, and the positioning block is connected and secured on the textured finish section of the positioning bolt through the second through hole. The clamping plate has a third through hole axially penetrating therethrough, and two pairs of engaging protrudes are formed at corresponding positions on the inner edge of the third through hole, and each pair of the engaging protrudes has an engaging groove formed therebetween. The middle section of the third through hole comprises a blocking rib, and a plurality of fourth through holes axially penetrate through the clamping plate near the edge thereof, and each of locking members is adapted to screw into the fourth through hole. The rotating member has a flange protruding from the outer periphery of an open end of the rotating member, and at least a positioning protrude is formed on the flange, and the inner periphery of the rotating member comprises a guiding groove.

Comparing with conventional clamp, the present invention is advantageous because: the force from the clamping portion not directly acts on the fixed clamp and the hardness of the clamping block and the hardness of the engaging block are harder than the fixed clamp, which increases the durability of the clamp of the prevent invention.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
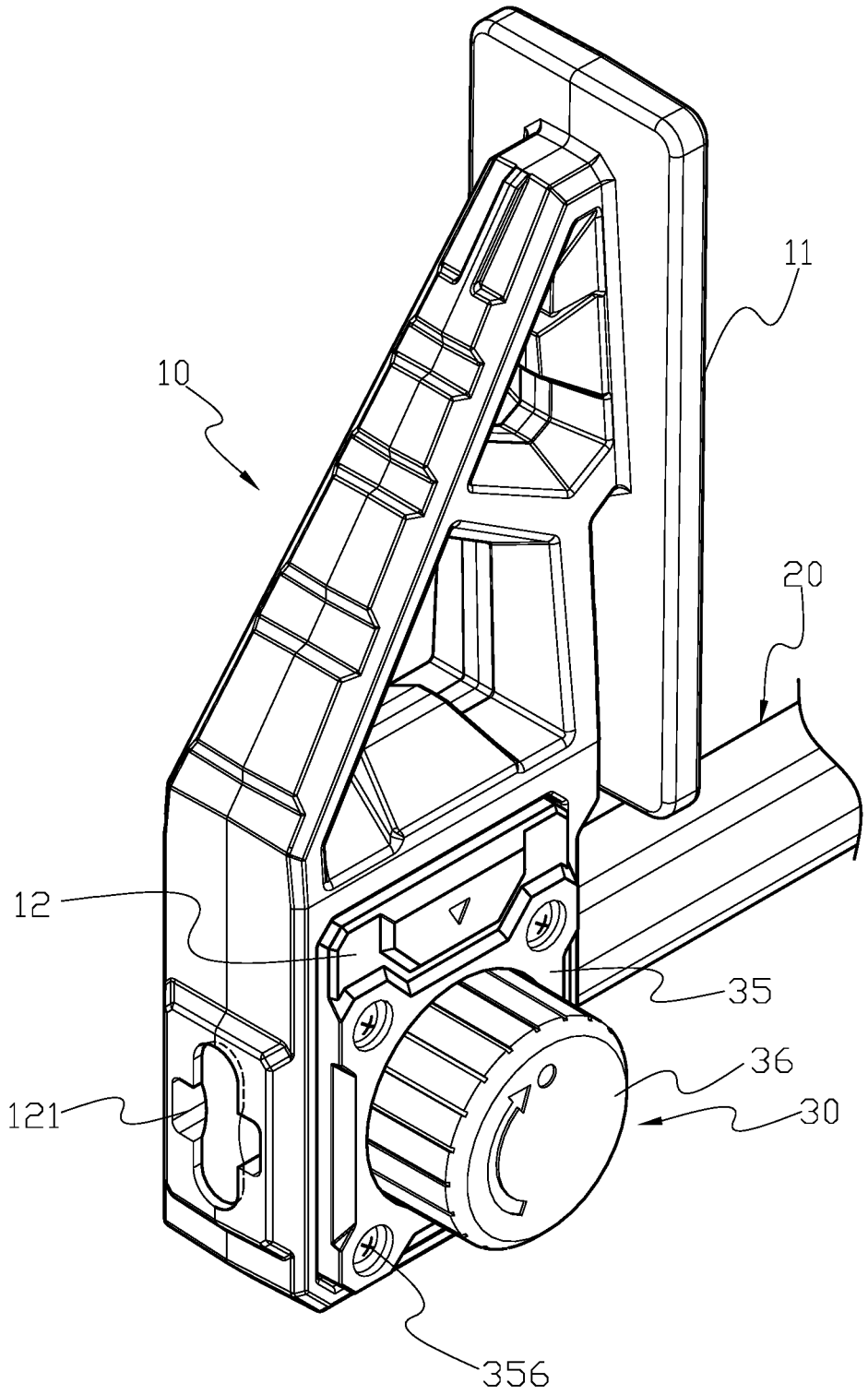
FIG. 1 is a three-dimensional assembly view of a positioning structure of clamp of the present invention.
Figure 2:
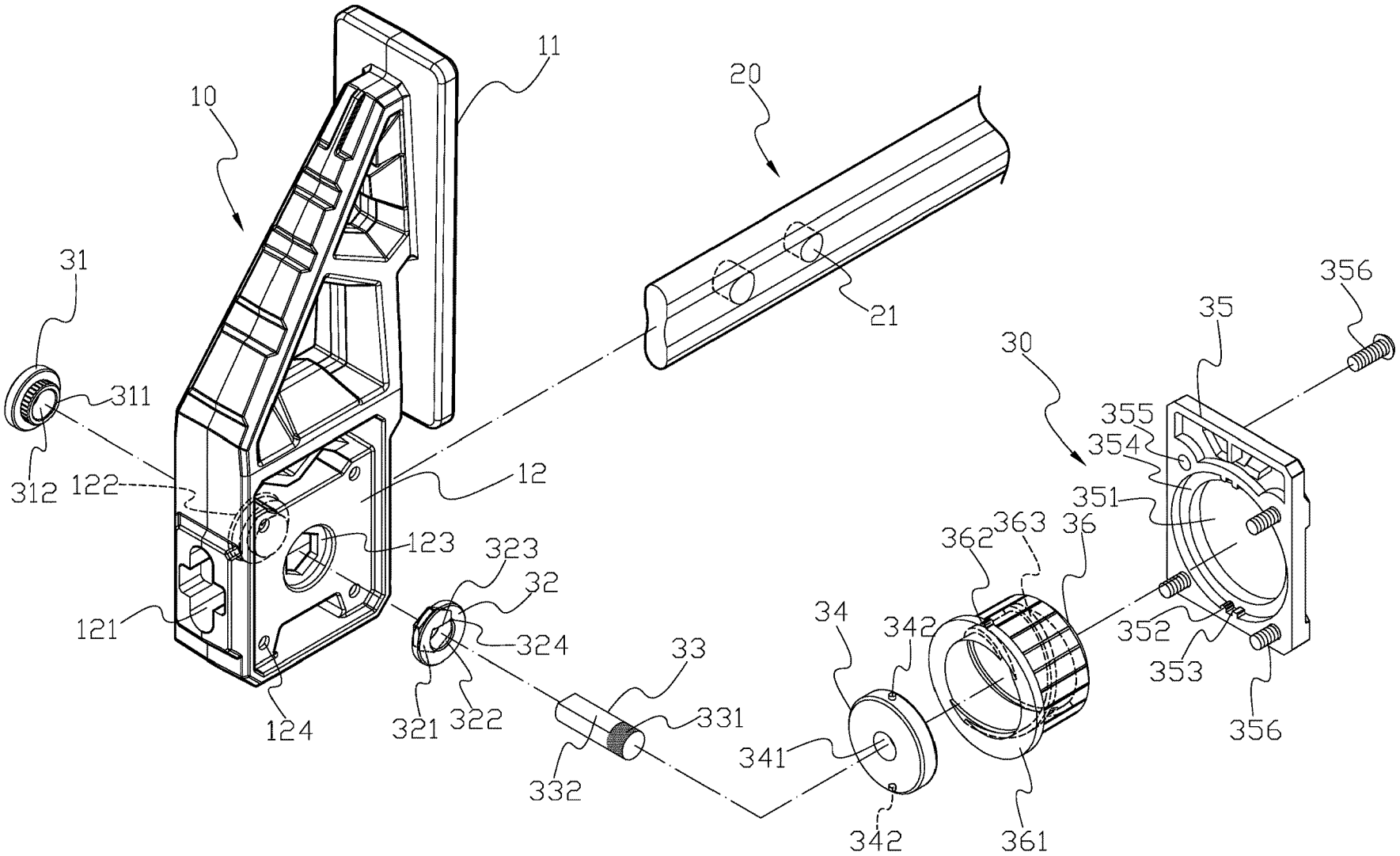
FIG. 2 is a three-dimensional explored view of the positioning structure of clamp of the present invention.
Figure 3:
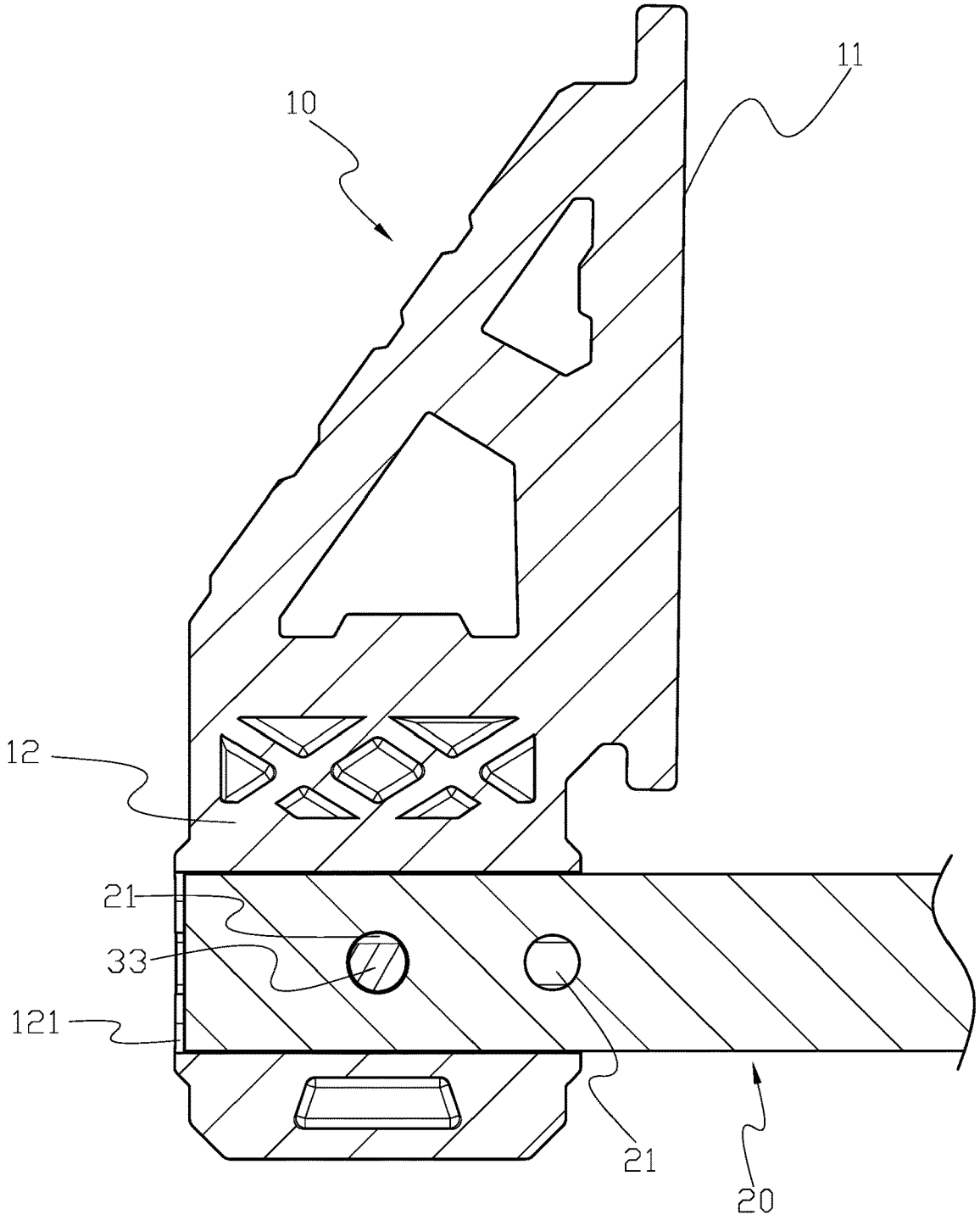
FIG. 3 is a schematic sectional view illustrating a positioning bolt is inserted into first through hole of a guiding rod of the clamp of the present invention.
Figure 4:
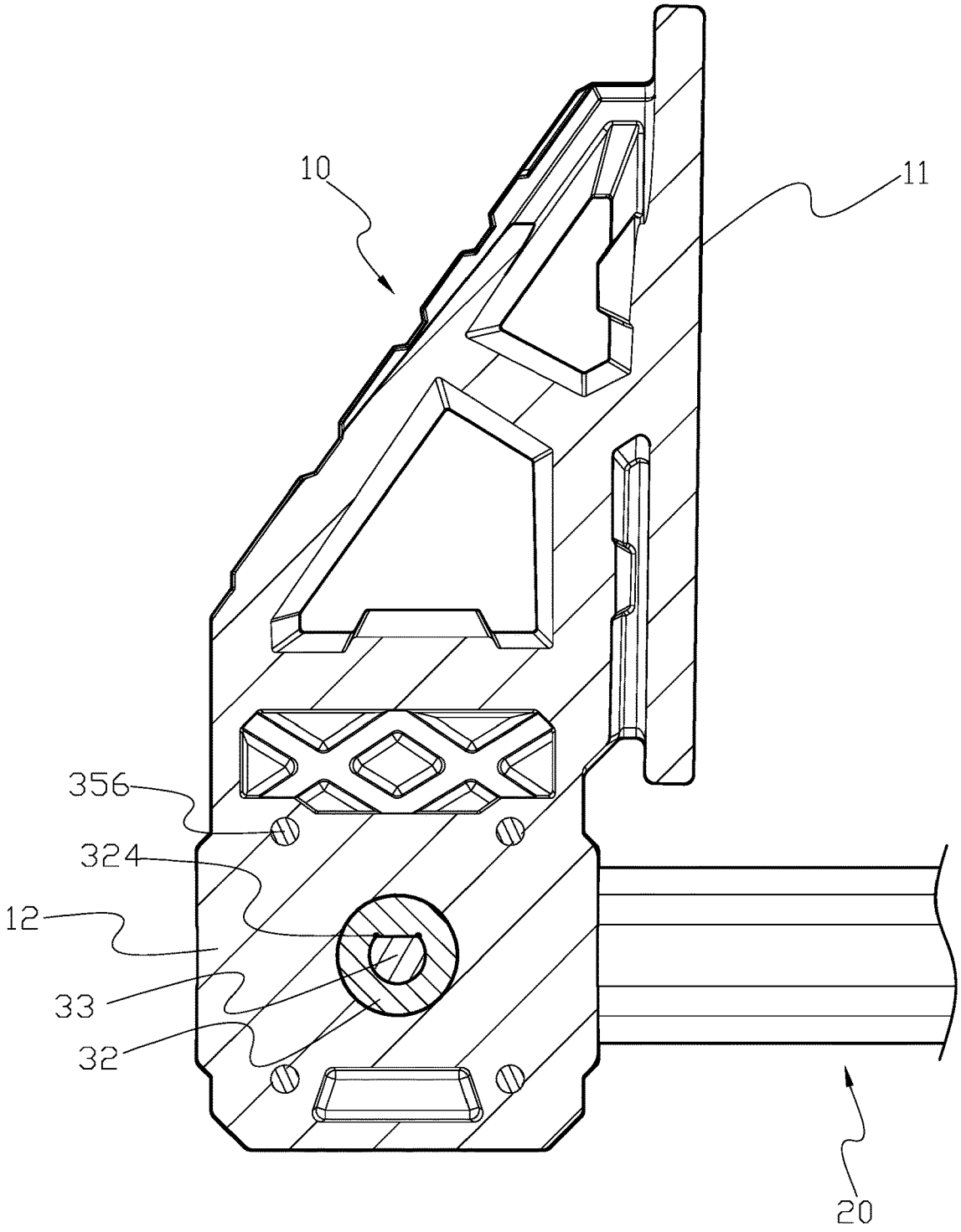
FIG. 4 is a schematic view illustrating the positioning bolt is coupled with a second connecting hole of an engaging block of the clamp of the present invention.
Figure 5:
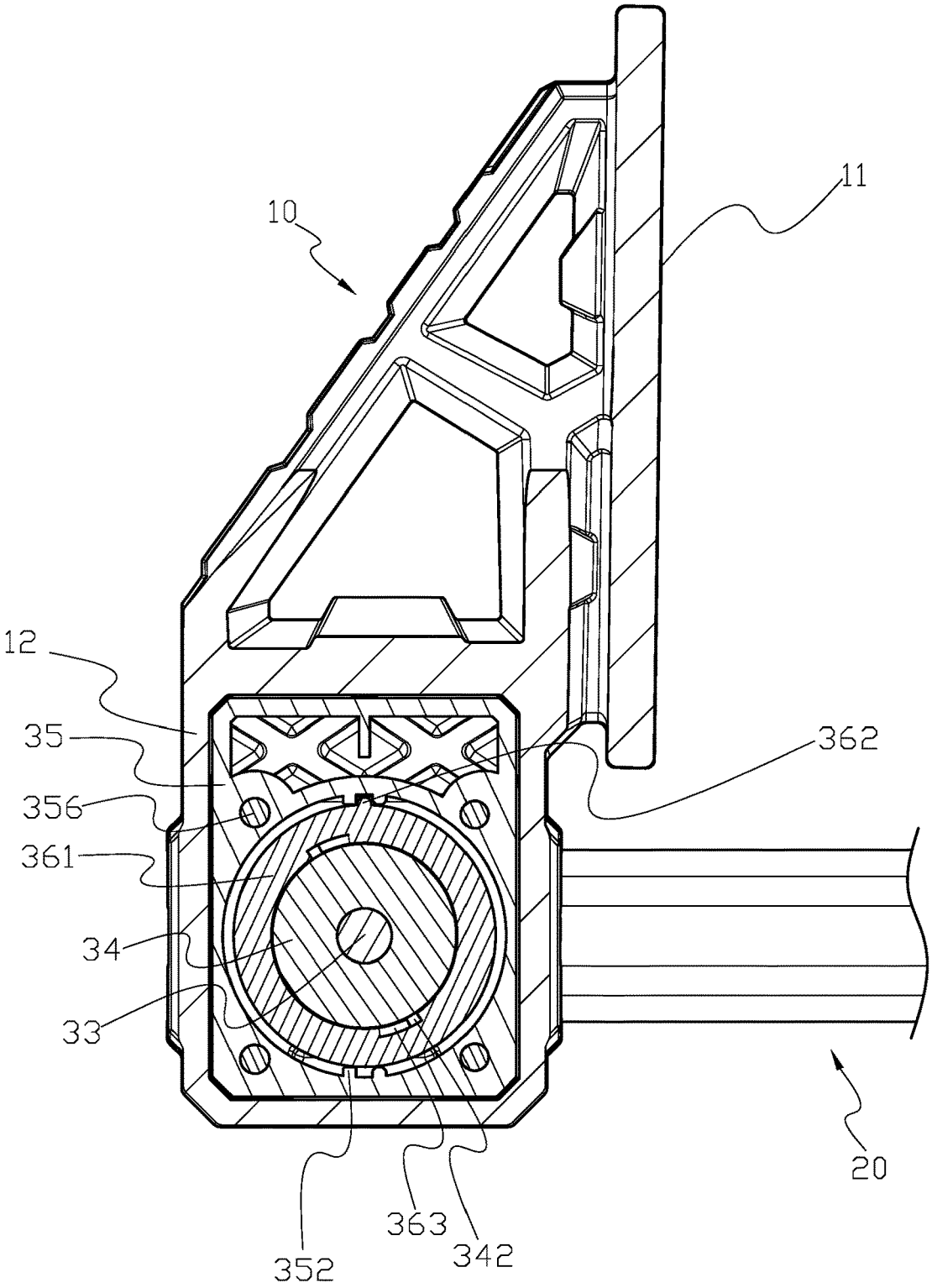
FIG. 5 is a sectional assembly view of a rotating member and a clamping plate of a positioning unit of the clamp in the present invention.

In order to further understand the goal, characteristics and effect of the present invention, a number of embodiments along with the drawings are illustrated as following:

Referring to FIGS. 1 and 2, the present invention provides a positioning structure of clamp comprising a fixed clamp (10) and a guiding rod (20), and the fixed clamp (10) has a clamping portion (11) and a connecting portion (12) respectively at an upper portion and a lower portion thereof, and a guiding hole (121) penetrates through the connecting portion (12). The guiding rod (20) coupled into the guiding hole (121) of the connecting portion (12) comprises a plurality of first through holes (21) thereon, and a first engaging hole (122) and a second engaging hole (123) respectively penetrating through two lateral sides of the connecting portion (12) are respectively communicated with the guiding hole (121). Moreover, a plurality of lock holes (124) are formed at the lateral side of the connecting portion (12) same as the second engaging hole (123). A positioning unit (30), which is connected to the connecting portion (12) through the first engaging hole (122), the second engaging hole (123), and the lock holes (124), comprises a clamping block (31), an engaging block (32), a positioning bolt (33), a positioning block (34), a clamping plate (35), and a rotating member (36). The clamping block (31) has an engaging ring (311) protruding from an end thereof, and the outer periphery of the engaging ring (311) is formed into peripheral teeth, and a first connecting hole (312) axially penetrates through the center of the clamping block (31). The engaging block (32) comprises a positioning ring (321) protruding from an end thereof, and a second connecting hole (322) axially penetrates through the center of the engaging block (32). An engaging surface (323) is formed at an end of the second connecting hole (322), and each of two sides of the engaging surface (323) has a guiding portion (324). The positioning bolt (33) has a textured finish section (331) at the outer periphery of one section of the positioning bolt (33) while the other section thereof comprises a positioning plane (332). The positioning block (34) comprises a second through hole (341) axially penetrating through the center thereof, and at least two guiding columns (342) protrude from the outer periphery of the positioning block (34), and the positioning block (34) is connected and secured on the textured finish section (331) of the positioning bolt (33) through the second through hole (341). The clamping plate (35) has a third through hole (351) axially penetrating therethrough, and two pairs of engaging protrudes (352) are formed at corresponding positions on the inner edge of the third through hole (351), and each pair of the engaging protrudes (352) has an engaging groove (353) formed therebetween. The middle section of the third through hole (351) comprises a blocking rib (354), and a plurality of fourth through holes (355) axially penetrate through the clamping plate (35) near the edge thereof, and each of locking members (356) is adapted to screw into the fourth through hole (355). The rotating member (36) has a flange (361) protruding from the outer periphery of an open end of the rotating member (36), and at least a positioning protrude (362) is formed on the flange (361), and the inner periphery of the rotating member (36) comprises a guiding groove (363).

Structurally, referring to FIGS. 2 to 5, the clamping block (31) and the engaging block (32) are pressed into the first engaging hole (122) and the second engaging hole (123) respectively, and are positioned at the connecting portion (12) of the fixed clamp (10). The guiding rod (20) is coupled into the guiding hole (121) of the connecting portion (12). After one of the first through holes (21) on the guiding rod (20) is selected, the guiding column (342) of the positioning block (34) is aligned with the guiding groove (363) of the rotating member (36), and positioning block (34) is locked into the rotating member (36) through the guiding groove (363). Furthermore, an end of the positioning bolt (33) having the positioning plane (332) is coupled with the second connecting hole (322) of the engaging block (32), and the positioning plane (332) is coupled with the engaging surface (323), and the guiding portion (324) of the engaging block (32) is configured to enable the positioning plane (332) shiftable along the engaging surface (323) when the positioning bolt (33) is slightly shaken. The positioning bolt (33) penetrates through the first through hole (21) of the guiding rod (20) and inserts into the first connecting hole (312) of the clamping block (31) on the other lateral side of the fixed clamp (10), so that the positioning bolt (33) is adapted to secure the position of the guiding rod (20). The clamping plate (35) is disposed on the rotating member (36) through the third through hole (351), and the engaging groove (353) is engaged with the positioning protrude (362) of the rotating member (36), and the clamping plate (35) is abutted against the side of the connecting portion (12) of the fixed clamp (10) having the lock holes (124). Moreover, the blocking rib (354) of the clamping plate (35) is abutted against the flange (361) of the rotating member (36), and the fourth through holes (355) of the clamping plate (35) are respectively aligned with the lock holes (124) of the connecting portion (12), and the clamping plate (35) is secured on the connecting portion (12) of the fixed clamp (10) through the locking members (356).

Figure 8:
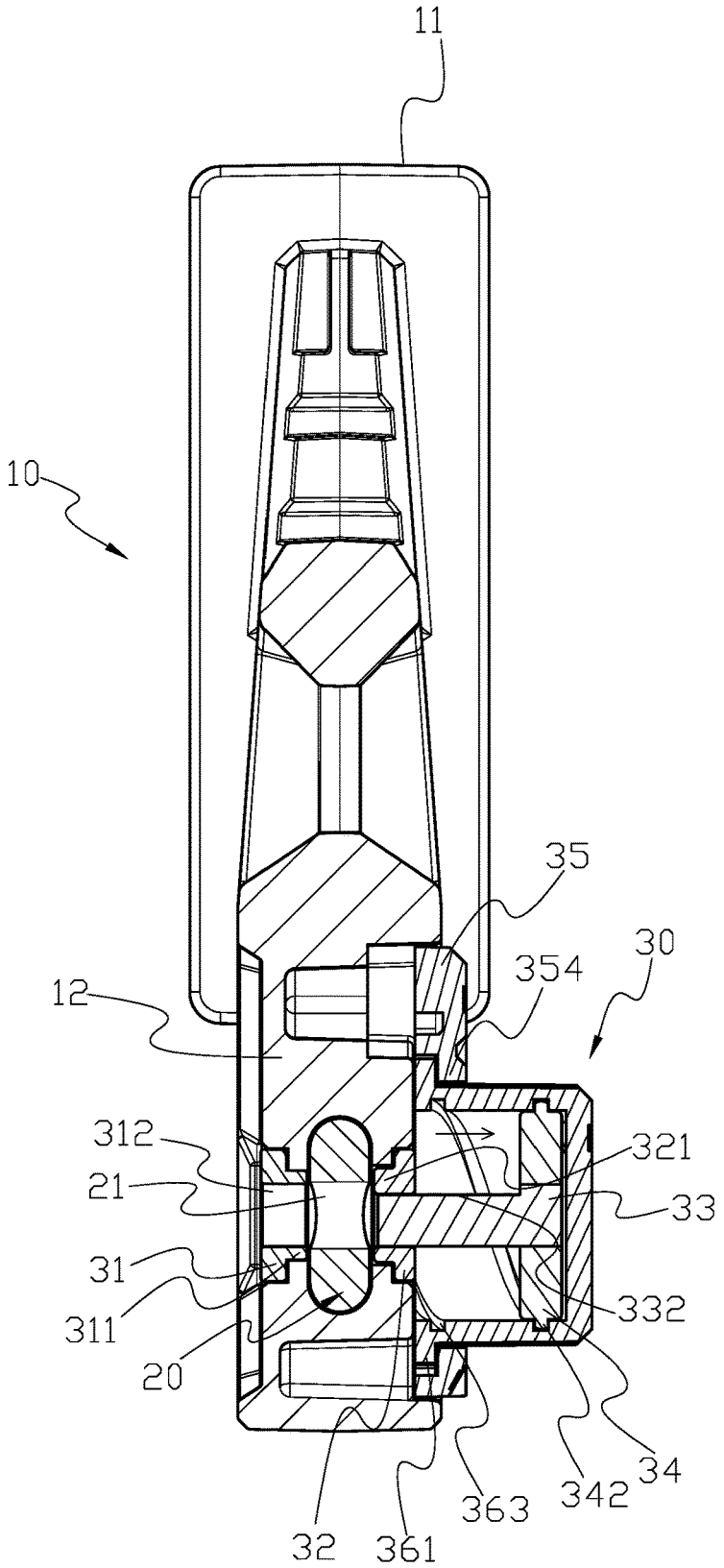
FIG. 8 is a schematic view illustrating the positioning bolt is detached from the guiding rod.

In actual application, referring to FIG. 8, when the position of the fixed clamp (10) needs to be replaced, the user can rotate the rotating member (36) in a counter-clockwise direction, and the positioning protrude (362) of the rotating member (36) is abutted against the engaging protrude (352) of the clamping plate (35). Meanwhile, when the elastic engaging protrude (352) is pressed and slightly tilted outwardly, the positioning protrude (362) is detached from the engaging groove (353), and the rotating member (36) is moved along the guiding groove (363) to drive the guiding column (342) of the positioning block (34), and the positioning bolt (33) is horizontally moved and detached from the first through hole (21) of the guiding rod (20). Thereafter, the positioning protrude (362) of the rotating member (36) is abutted against the engaging protrude (352) of the clamping plate (35), and the pressed engaging protrude (352) is inwardly tilted so that the positioning protrude (362) of the rotating member (36) is coupled into the engaging groove (353) between the pair of the engaging protrudes (352) so as to secure the position of the rotating member (36), thereby completing the position change or the detachment of the fixed clamp (10).

Figure 6:
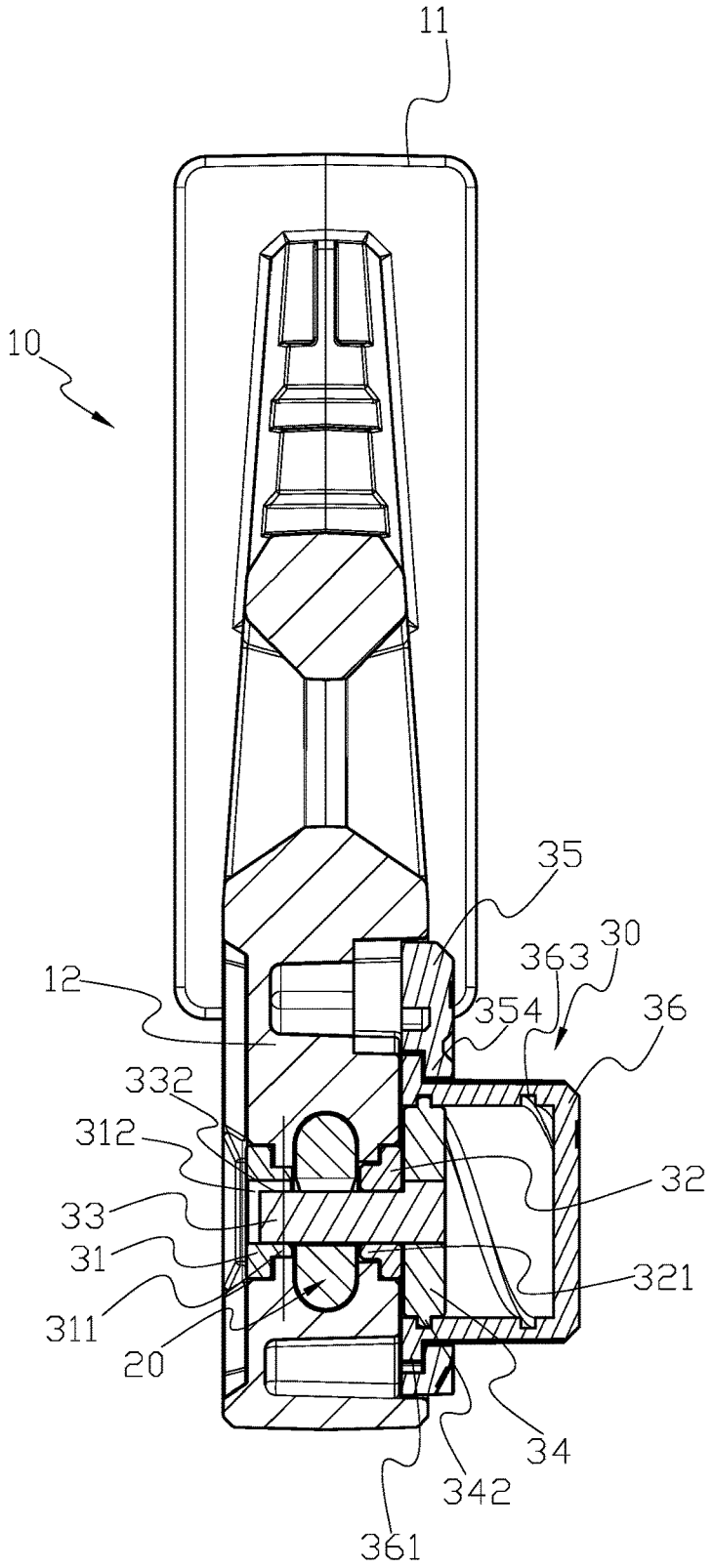
FIG. 6 is a schematic view illustrating a fixed clamp is secured through the positioning bolt of the clamp in the present invention.
Figure 7:
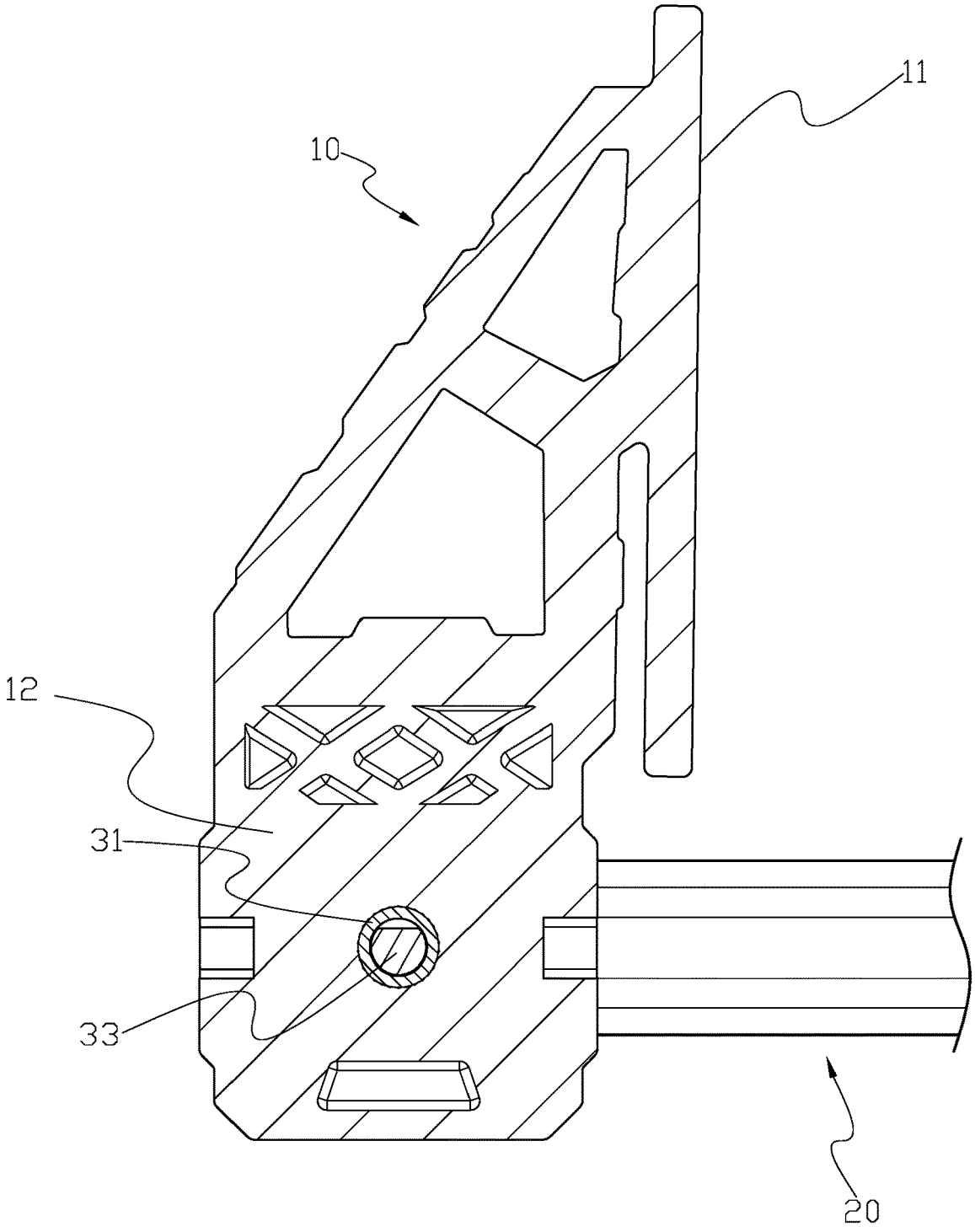
FIG. 7 is a sectional view illustrating the fixed clamp is coupled with a clamping block of the clamp in the present invention.

In one embodiment, conversely, referring to FIGS. 6 and 7, when the position of the fixed clamp (10) needs to be secured, the user can rotate the rotating member (36) in a clockwise direction, and the positioning protrude (362) of the rotating member (36) is abutted against the engaging protrude (352) of the clamping plate (35). Meanwhile, when the elastic engaging protrude (352) is pressed and slightly tilted outwardly, the positioning protrude (362) is detached from the engaging groove (353), and the rotating member (36) is moved along the guiding groove (363) to drive the guiding column (342) of the positioning block (34), and the positioning bolt (33) is horizontally moved and inserted into the first through hole (21) of the guiding rod (20). Thereafter, the positioning protrude (362) of the rotating member (36) is abutted against the engaging protrude (352) of the clamping plate (35), and the pressed engaging protrude (352) is inwardly tilted so that the positioning protrude (362) of the rotating member (36) is coupled into the engaging groove (353) between the pair of the engaging protrudes (352) so as to secure the position of the rotating member (36), thereby fixing the fixed clamp (10) on the guiding rod (20).

Figure 9:
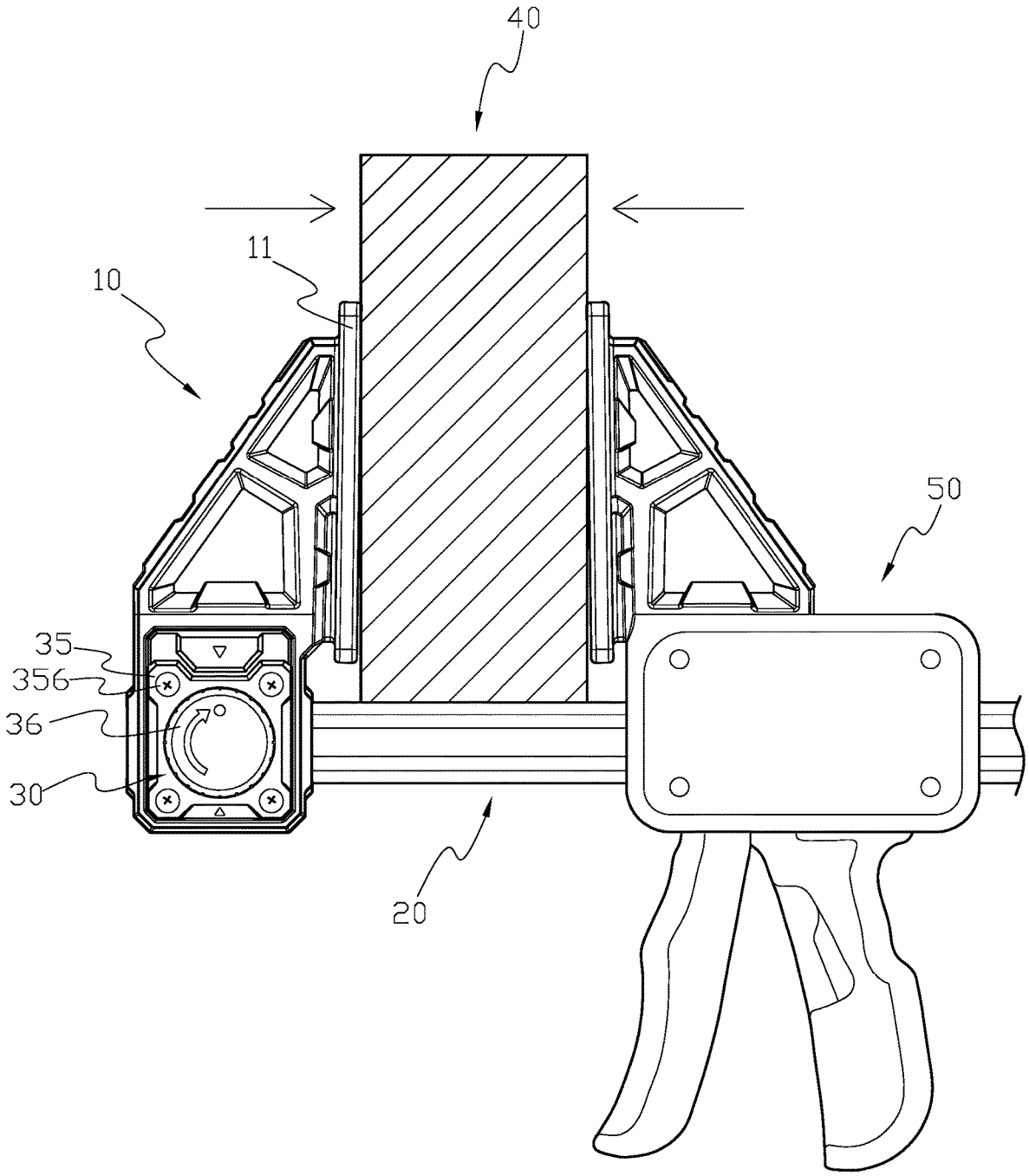
FIG. 9 is a schematic view illustrating the fixed clamp is cooperated with a movable adjustable clamp to clamp an object therebetween.
Figure 10:
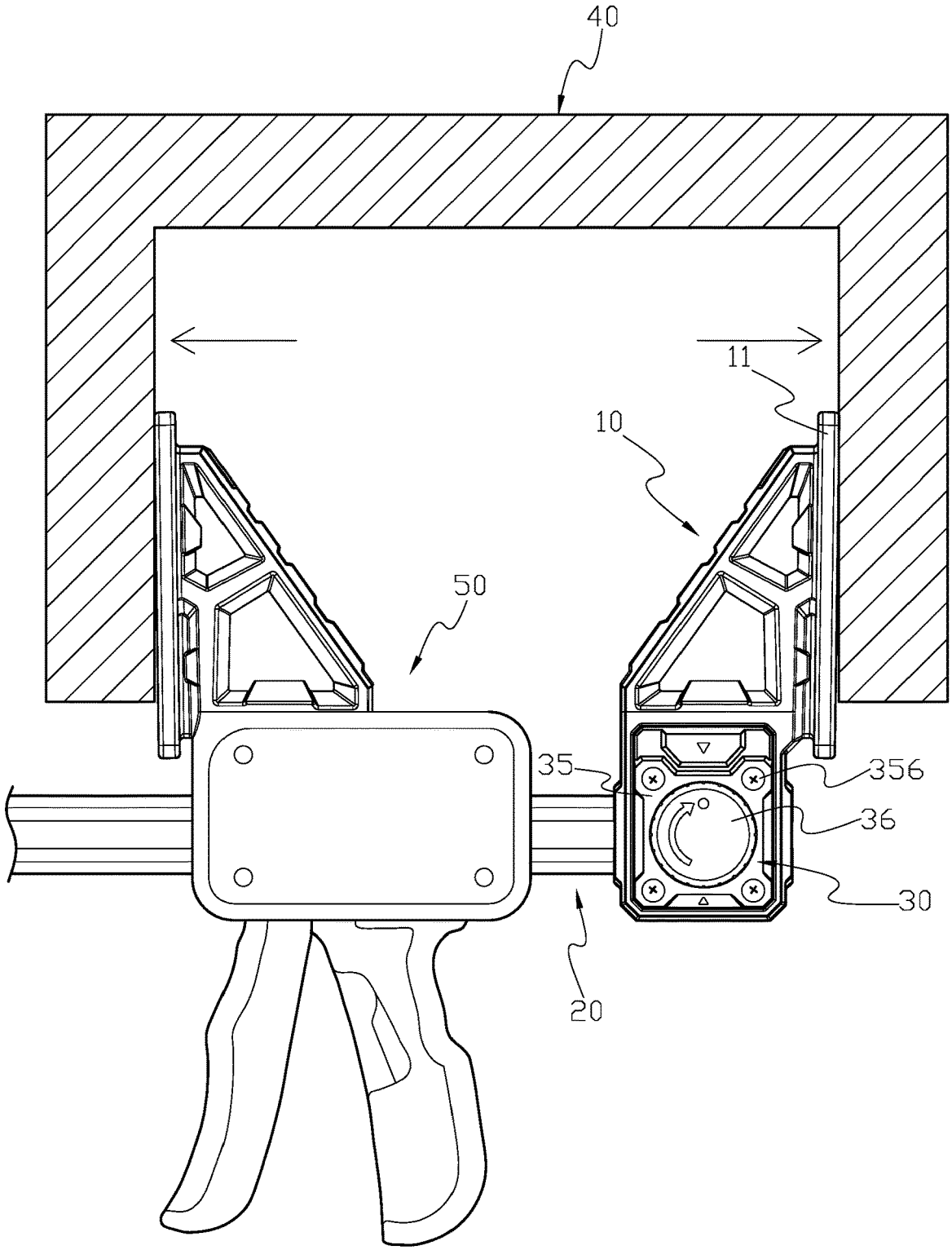
FIG. 10 is a schematic view illustrating the fixed clamp is cooperated with the movable adjustable clamp to clamp an object at the outer sides thereof.

When the clamp of the present invention clamps an object (40), referring to FIGS. 9 and 10, the position and direction of the fixed clamp (10) is adjustable. An adjustable clamp (50) is coupled on the guiding rod (20) at the opposite side of the fixed clamp (10), and fixed clamp (10), which can easily change position and direction, is cooperated with the movable adjustable clamp (50) to clamp the object (40) therebetween or at the outer sides thereof.

Figure 11:
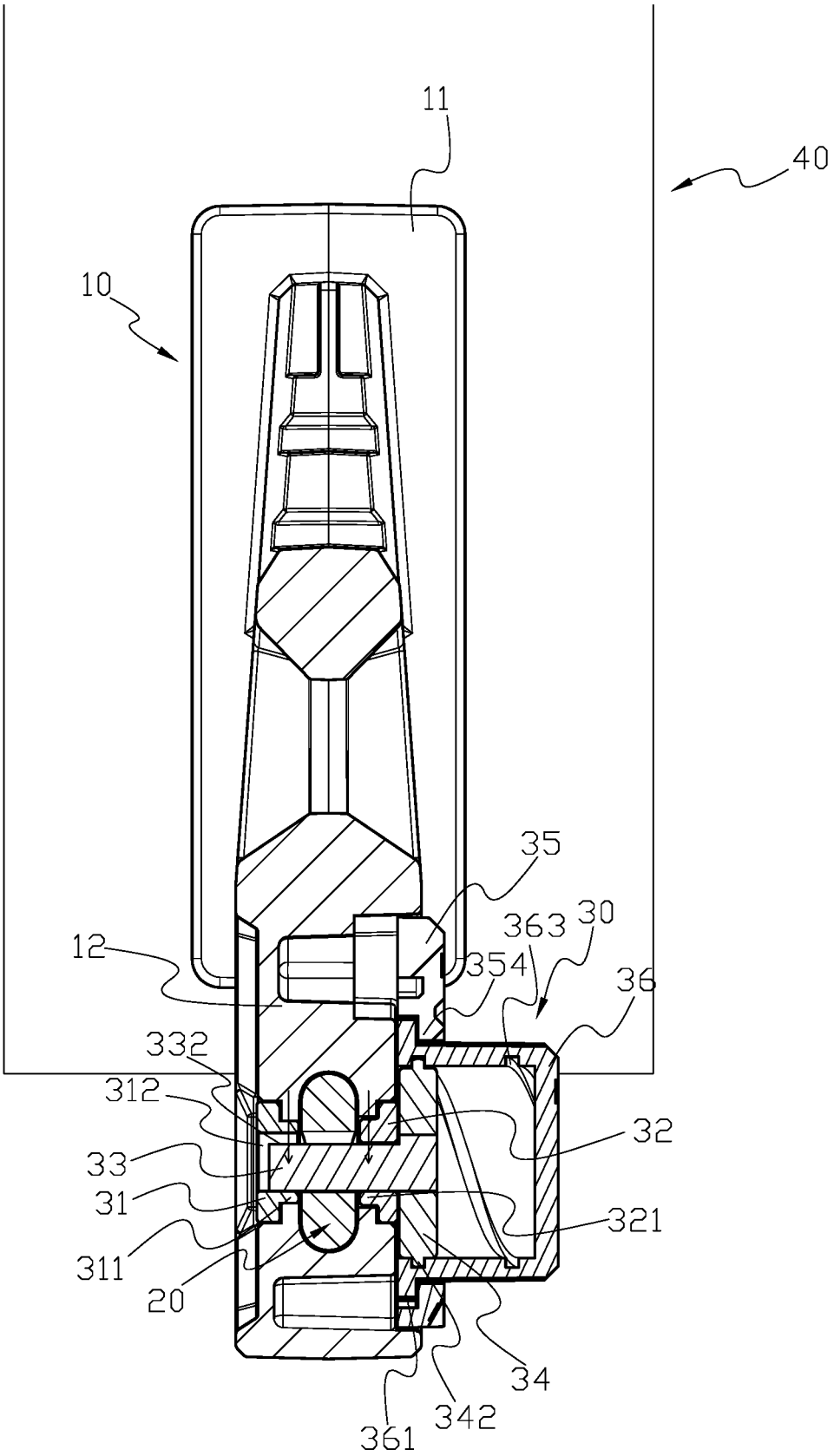
FIG. 11 is a schematic view illustrating when the object is clamped, a clamping portion of the fixed clamp is adapted to provide a diagonally downward force on the positioning bolt.
Figure 12:
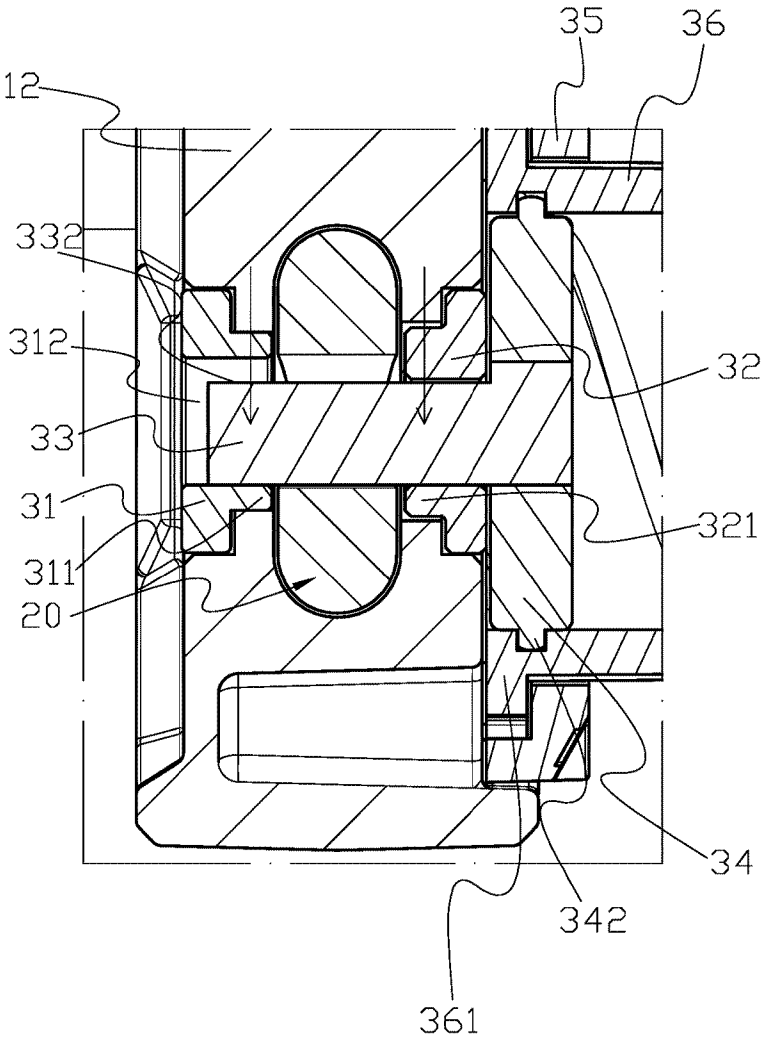
FIG. 12 is a partially enlarged schematic view illustrating the clamping block and the engaging block are forced.
Figure 12:
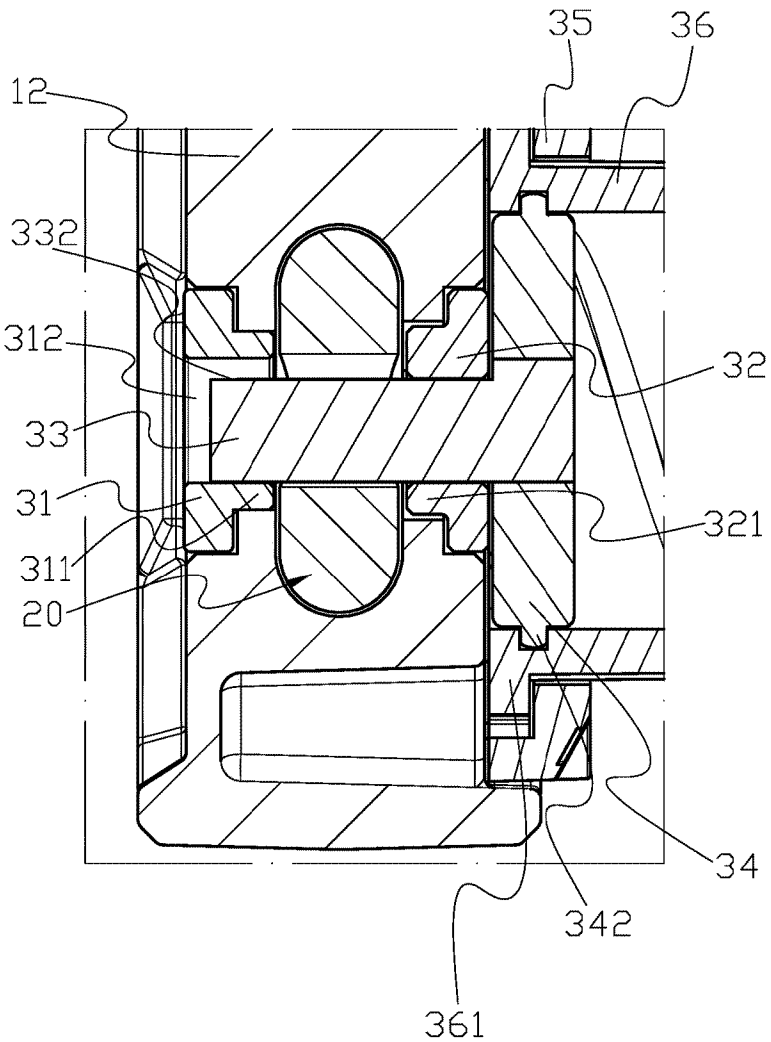

Referring to FIGS. 11 and 12, when the object (40) is clamped, the clamping portion (11) of the fixed clamp (10) is adapted to provide a diagonally downward force on the positioning bolt (33), and meanwhile, the positioning bolt (33) passes force through the clamping block (31) and the engaging block (32), which are positioned at two lateral sides of the fixed clamp (10), to the fixed clamp (10). Therefore, the force from the clamping portion (11) not directly acts on the fixed clamp (10), which prevents the looseness of the clamp structure due to the gap between the positioning bolt (33) and the fixed clamp (10), thereby increasing the durability of the clamp of the prevent invention.

In another embodiment, the clamping block (31) is made of the material having the hardness harder than that of the fixed clamp (10).

In still another embodiment, the engaging block (32) is made of the material having the hardness harder than that of the fixed clamp (10).

Figure 13:
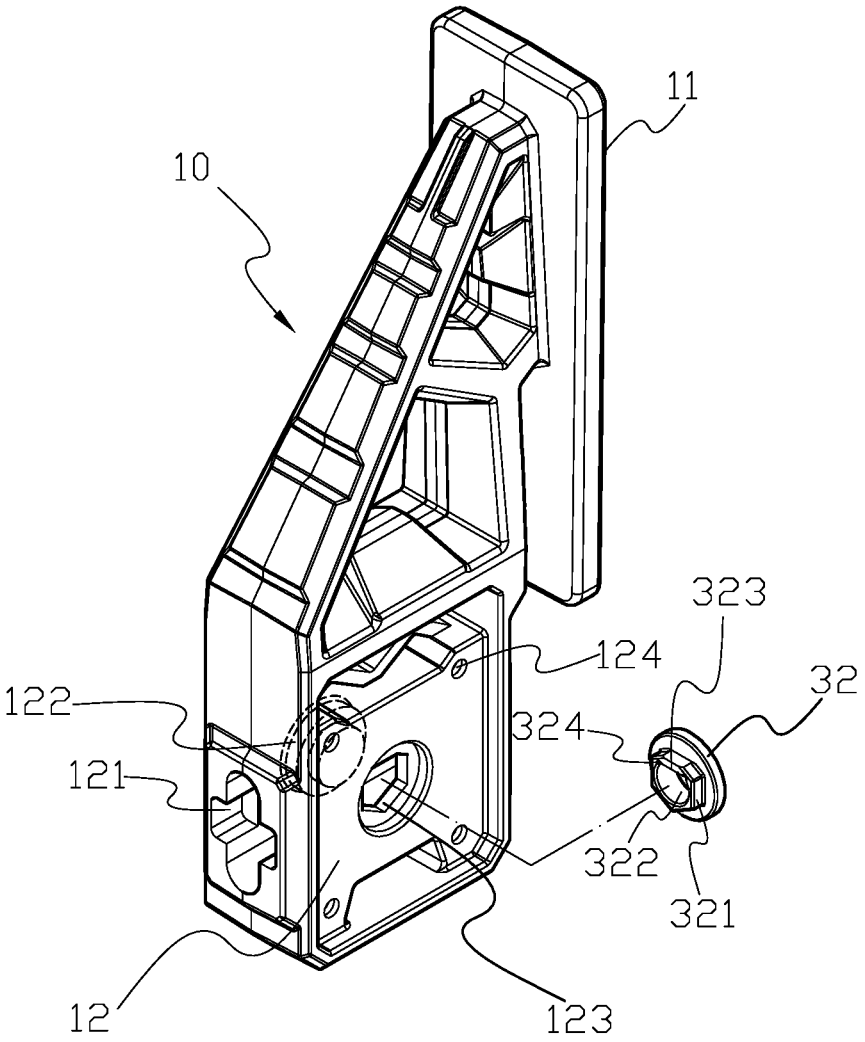
FIG. 13 is a schematic view illustrating a positioning ring of the engaging block has a polygonal cross section and comprises at least a plane for foolproof.
Figure 14:
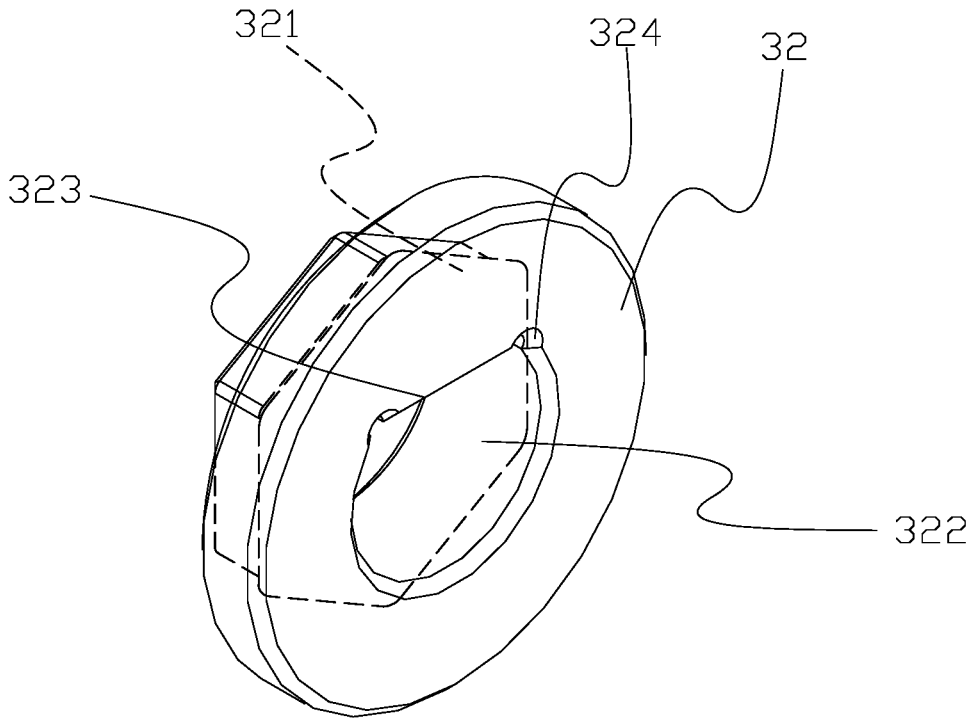
FIG. 14 is a three-dimensional enlarged view of the engaging block of the clamp of the present invention.

In a further embodiment, the positioning ring (321) of the engaging block (32) has a polygonal cross section (as shown in FIGS. 13 and 14).

In still a further embodiment, the positioning ring (321) of the engaging block (32) has at least a plane for foolproof (as shown in FIG. 13).

In a preferred embodiment, the positioning block (34) is secured on the textured finish section (331) of the positioning bolt (33) through the method of plastic cladding and molding.

In another preferred embodiment, the positioning ring (321) of the engaging block (32) has at least a foolproof structure.

Figure 15:
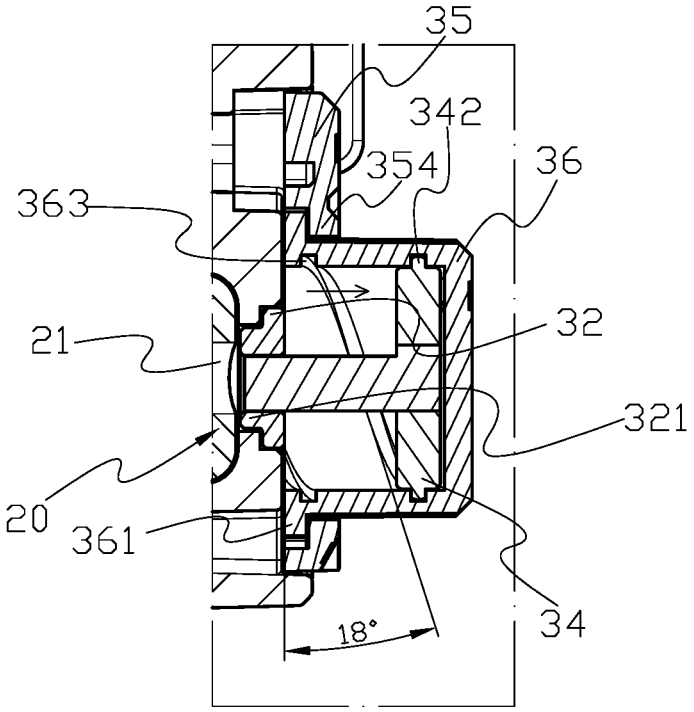
FIG. 15 is a schematic view illustrating the guiding angle of a guiding groove of the rotating member of the clamp in the present invention.

In an advantageous embodiment, the guiding groove (363) is tilted between 16 and 20 degrees (as shown in FIG. 15).

In another advantageous embodiment, at least one of the pair of the engaging protrudes (352) on the two sides of the engaging groove (353) has a round edge.

Comparing with conventional clamp, the present invention is advantageous because: the force from the clamping portion (11) not directly acts on the fixed clamp (10) and the hardness of the clamping block (31) and the hardness of the engaging block (32) are harder than the fixed clamp (10), which increases the durability of the clamp of the prevent invention.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A positioning structure of clamp comprising a fixed clamp and a guiding rod;

wherein the fixed clamp has a clamping portion and a connecting portion respectively at an upper portion and a lower portion thereof, and a guiding hole penetrates through the connecting portion; the guiding rod coupled into the guiding hole of the connecting portion comprises a plurality of first through holes thereon, and a first engaging hole and a second engaging hole respectively penetrating through two lateral sides of the connecting portion are respectively communicated with the guiding hole; a plurality of lock holes are formed at the lateral side of the connecting portion same as the second engaging hole; a positioning unit, which is connected to the connecting portion through the first engaging hole, the second engaging hole, and the lock holes, comprises a clamping block, an engaging block, a positioning bolt, a positioning block, a clamping plate, a locking member, and a rotating member; the clamping block has an engaging ring protruding from an end thereof, and an outer periphery of the engaging ring is formed into peripheral teeth, and a first connecting hole axially penetrates through a center of the clamping block; the engaging block comprises a positioning ring protruding from an end thereof, and a second connecting hole axially penetrates through the center of the engaging block; and engaging surface is formed at an end of the second connecting hole, and each of two sides of the engaging surface has a guiding portion; the positioning bolt has a textured finish section at an outer periphery of one section of the positioning bolt while a other section thereof comprises a positioning plane; the positioning block comprises a second through hole axially penetrating through a center thereof, and at least two guiding columns protrude from an outer periphery of the positioning block, and the positioning block is connected and secured on the textured finish section of the positioning bolt through the second through hole; the clamping plate has a third through hole axially penetrating therethrough, and two pairs of engaging protrudes are formed at corresponding positions on an inner edge of the third through hole, and each pair of the engaging protrudes has an engaging groove formed therebetween; a middle section of the third through hole comprises a blocking rib, and a plurality of fourth through holes axially penetrate through the clamping plate, and each of the locking members is adapted to screw into the fourth through hole; the rotating member has a flange protruding from an outer periphery of an open end of the rotating member, and at least a positioning protrude is formed on the flange, and an inner periphery of the rotating member comprises a guiding groove; and wherein the clamping block and the engaging block, configured to be pressed into the first engaging hole and the second engaging hole respectively, are positioned at the connecting portion of the fixed clamp, and the guiding rod is coupled into the guiding hole of the connecting portion; after one of the first through holes on the guiding rod is selected, the guiding column of the positioning block is aligned with the guiding groove of the rotating member, and the positioning block is locked into the rotating member through the guiding groove; an end of the positioning bolt having the positioning plane is coupled with the second connecting hole of the engaging block, and the positioning plane is coupled with the engaging surface, and the guiding portion of the engaging block is configured to enable the positioning plane shiftable along the engaging surface when the positioning bolt is slightly shaken; the positioning bolt penetrates through the first through hole of the guiding rod and inserts into the first connecting hole of the clamping block on another lateral side of the fixed clamp, so that the positioning bolt is adapted to secure a position of the guiding rod; the clamping plate is disposed on the rotating member through the third through hole, and the engaging groove is engaged with the positioning protrude of the rotating member, and the clamping plate is abutted against a side of the connecting portion of the fixed clamp having the lock holes; and the blocking rib of the clamping plate is abutted against the flange of the rotating member, and the fourth through holes of the clamping plate are respectively aligned with the lock holes of the connecting portion, and the clamping plate is secured on the connecting portion of the fixed clamp through the locking members.

2. The positioning structure of clamp of claim 1, wherein the positioning ring of the engaging block has a polygonal cross section.

3. The positioning structure of clamp of claim 1, wherein the positioning block is secured on the textured finish section of the positioning bolt through a method of plastic cladding and molding.

4. The positioning structure of clamp of claim 1, wherein the guiding groove is tilted between 16 and 20 degrees.

5. The positioning structure of clamp of claim 1, wherein at least one of the pair of the engaging protrudes on the two sides of the engaging groove has a round edge.

* * * * *